US005570008A

United States Patent [19]

Goetz

[11] Patent Number: 5,570,008

[45] Date of Patent: Oct. 29, 1996

[54] BAND GAP REFERENCE VOLTAGE SOURCE

[75] Inventor: Laszlo Goetz, Freising, Germany

[73] Assignee: Texas Instruments Deutschland GmbH, Germany

[21] Appl. No.: 227,427

[22] Filed: Apr. 14, 1994

[51] Int. Cl.[6] ..... G05F 3/20

[52] U.S. Cl. ..... 323/315; 323/907

[58] Field of Search ..... 323/315, 316, 323/313, 907

[56] References Cited

U.S. PATENT DOCUMENTS 4,396,883 8/1983 Holloway et al. ..... 323/313
4,435,678 3/1984 Joseph et al. ..... 323/315
4,677,368 6/1987 Bynum ..... 323/315
4,797,577 1/1989 Hing ..... 323/907

*Primary Examiner*—Peter S. Wong
*Assistant Examiner*—Shawn Riley
*Attorney, Agent, or Firm*—William E. Hiller; Richard L. Donaldson

[57] ABSTRACT

For compensating the Early effect a band gap reference voltage source includes current mirror circuits ($T_4$, $Q_3$ and $T_1$, $Q_1$ as well as $T_2$, $Q_2$) to ensure that the currents necessary for achieving the temperature-compensated output voltage are generated. Using the current mirror circuits makes the reference voltage source independent of changes in the supply voltage ($U_{cc}$) and enables it in particular to be employed at supply voltages as of low as 3 V.

5 Claims, 3 Drawing Sheets

BAND GAP REFERENCE VOLTAGE SOURCE

The invention relates to a band gap reference voltage source comprising two bipolar transistors operated at differing current densities, the emitter of one transistor being connected via a resistor to a resistor connected to a terminal of a supply voltage whilst the emitter of the other transistor is connected directly thereto, and a voltage follower stage for generating the reference voltage at the output thereof as a function of the collector voltage of one of the transistors, said reference voltage also being applied to the two transistors as the base voltage.

BACKGROUND OF THE INVENTION

A band gap reference voltage source is disclosed by the semiconductor circuitry text book "Halbleiter-Schaltungstechnik" by U. Tietze and Ch. Schenk published by Springer Verlag, 9th edition, pages 558 et seq. In this known band gap reference voltage source the base-emitter voltage of a bipolar transistor is employed as the voltage reference. The temperature coefficient of this voltage of −2 mV/K is markedly high for the voltage value of 0.6 V. Compensating this temperature coefficient is achieved by adding to it a temperature coefficient of +2 mV/K produced by a second transistor. It can be shown that by operating the two transistors at differing current densities a highly accurate reference voltage of 1.205 V can be achieved which exhibits no dependency on temperature.

This known band gap reference voltage source has the disadvantage, however, that its temperature independence applies only for a certain supply voltage. This is due to the so-called Early effect which manifests itself by the collector current being a function of the collector emitter voltage of a transistor. When there is a change in the supply voltage of the known band gap reference voltage source, therefore, the current values in the individual branches of the circuit change so that the current ratios necessary for achieving temperature compensation no longer apply. The generated reference voltage is accordingly no longer independent of the temperature.

One way of solving this problem would be to generate the currents needed by means of current mirrors, for which proposals already exist, to more or less completely eliminate the influence of the Early effect. Such compensated current mirror circuits are disclosed for instance in the textbook on integrated bipolar circuits "Integrierte Bipolarschaltungen" by H.-M. Rein, R. Ranfft, published by Springer Verlag 1980, pages 250 et seq. for bipolar transistors. For current mirrors comprising field-effect transistors, circuits for eliminating the Early effect—also termed lambda effect in conjunction with literature on field-effect transistors—are described in "CMOS Analog Circuit Design" by Phillip E. Allen and Douglas R. Holberg, Holt, Rinehart and Winston, Inc. pages 237 et seq.

One drawback of using compensated current mirrors to generate the currents required in a band gap reference voltage source is that it is no longer possible to operate such compensated current mirrors with voltages of less than 3 V. This results from the physical parameters of the semiconductor elements used which require certain minimum voltages (voltage $V_{BE}$ for bipolar transistors and the threshold voltage $V_T$ for field-effect transistors) for their operation.

More recently, however, a growing need for band gap reference voltage sources capable of being operated with operating voltages of around 3 V and less has arisen, this being due to the 5 V supply voltage formerly always used in digital circuitry now being replaced more and more by a supply voltage of 3 V.

The object of the invention is based on creating a band gap reference voltage source capable of generating a precisely temperature-compensated stable reference voltage in a broad supply voltage range down to 3 V.

SUMMARY OF THE INVENTION

This object is achieved by the invention providing parallel to the two first branch circuits containing the bipolar transistors a further bipolar transistor which together with each of the first circuit branches forms a current mirror and thus generating the currents required for achieving the differing current densities in the two first branch circuits and by the voltage follower stage obtaining the voltage at the collector of the further bipolar transistor as the input voltage.

A further achievement of the object forming the basis of the invention involves circuiting the voltage follower stage in parallel with the two branch circuits containing the bipolar transistors including a further bipolar transistor circuited as a diode, the collector of which is connected to the output of the voltage follower stage whose emitter is connected via a resistor to a further resistor which is connected to one terminal of the supply voltage and whose base is connected to its collector and to the base connections of the two bipolar transistors, the branch circuit containing the transistor circuited as a diode in combination with one of the two other branch circuits respectively generating a current mirror for setting the currents in the two other branch circuits required for the differing current densities.

In the band gap reference voltage source according to the invention current mirror circuits are achieved by making use of existing transistors to generate the necessary currents without the magnitude of the supply voltage being limited downwards. The band gap reference voltage source according to the invention can thus be operated with supply voltages of 3 V.

BRIEF DESCRIPTION OF THE DRAWINGS

Example embodiments of the invention will now be described in full detail with reference to the drawing in which.

DESCRIPTION OF THE PREFERRED EMBODIMENTS

Figure 1:
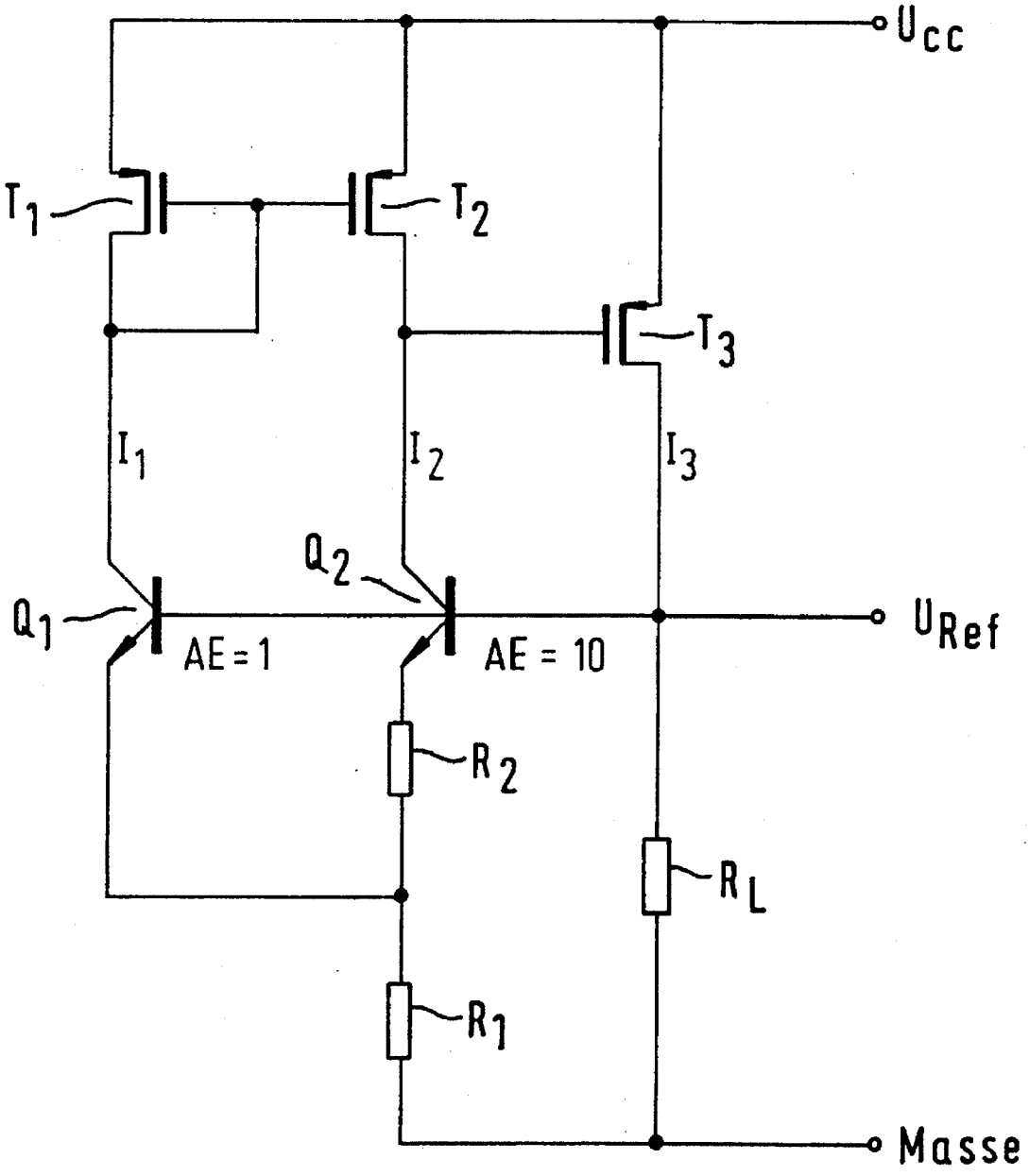
FIG. 1 is a circuit diagram of a known band gap reference voltage source.

The band gap reference voltage source shown in FIG. 1 corresponds to prior art as disclosed by the semiconductor circuitry text book "Halbleiter-Schaltungstechnik" by U. Tietze and Ch. Schenk published by Springer Verlag, 9th edition, pages 558 et seq. The only difference to the circuit shown and described by this disclosure is that the resistors inserted for the currents $I_1$ and $I_2$ in the collector leads of the bipolar transistors $Q_1$ and $Q_2$ are replaced by field-effect resistors $T_1$ and $T_2$. The voltage follower stage comprises a field-effect transistor $T_3$ and a resistor $R_L$. One salient requirement for the band gap reference voltage source as shown in FIG. 1 to function is that differing current densities exist in the transistors $Q_1$ and $Q_2$. This is achieved in the example shown in FIG. 1 by making the emitter surface area of transistor $Q_2$ ten-times larger than that of transistor $Q_1$ and the collector currents $I_1$, $I_2$ being equal. The differing emitter surface areas are indicated in FIG. 1 by AE=1 and AE=10.

When the current $I_1$ equals the current $I_2$ in the circuit shown in FIG. 1 the current densities in the two transistors $Q_1$ and $Q_2$ differ as is necessary for the circuit to function as a band gap reference voltage source. These two currents are only the same, however, when the voltages at the collectors of the transistors $Q_1$ and $Q_2$ are the same which in turn can only be the case when the current $I_3$ is also equal to the current $I_1$ and $I_2$. This condition will only be achieved, however, for a certain supply voltage $V_{cc}$. Due to the Early effect (lambda effect in the case of field-effect transistors) the condition that the collector voltage of the transistors $Q_1$ and $Q_2$ remain the same when there is a change in the supply voltage $V_{cc}$ cannot be maintained. This results in temperature stabilization of the output voltage $V_{Ref}$ no longer being achieved in its full scope.

Figure 2:
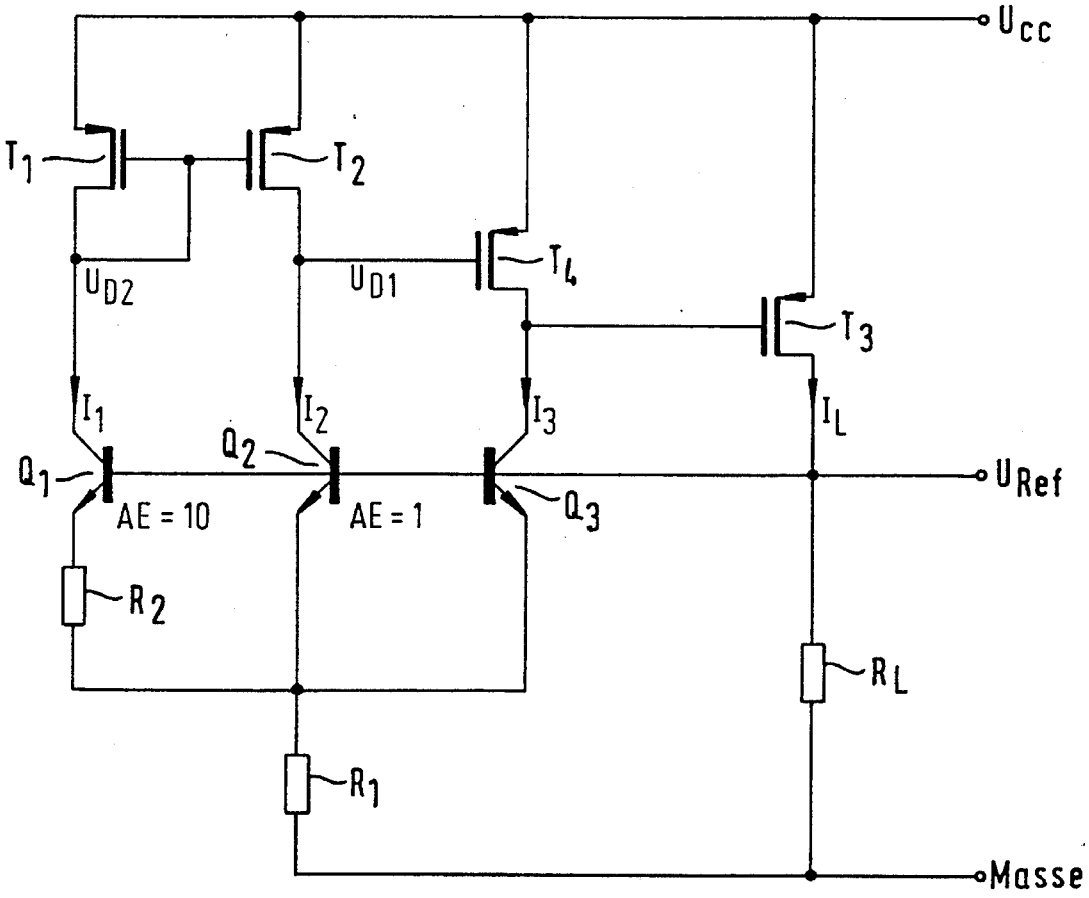
FIG. 2 is a circuit diagram of a first band gap reference voltage source according to the invention.

The circuit as shown in FIG. 2 illustrates an achievement enabling the voltages $V_{D2}$ and $V_{D1}$ and thus the currents $I_1$ and $I_2$ to be regulated to equal values irrespective of changes in the supply voltage $V_{cc}$.

As can be seen from the circuit shown in FIG. 2 a third branch circuit incorporating the transistors $T_4$ and $Q_3$ has been added to the two branch circuits comprising the transistors $T_1$ and $Q_1$ and $T_2$ and $Q_2$. This new branch circuit forms, on the one hand, together with the branch circuit containing the transistors $T_2$ and $Q_2$ one current mirror and, on the other, together with the branch circuit of $T_1$ and $Q_1$ another current mirror ensuring that the currents $I_3$ and $I_2$ or $I_3$ and $I_1$ respectively remain equal. This also means, however, that the currents $I_1$ and $I_2$ are regulated to equal values.

Due to the fact that the current mirror of the transistors $T_1$, $Q_1$ and $T_4$ and $Q_3$ forces the two currents $I_1$ and $I_3$ to be equal it can be deduced that the voltage $V_{D2}$ equals the voltage $V_{D1}$, it only being then, when the gate voltages of the transistors $T_1$ and $T_4$ are equal, that the currents flowing through these transistors are also equal. Since, however, transistor $T_2$ also receives the voltage $V_{D2}$ as its gate voltage the current $I_2$ will also be just as large as the currents $I_1$ and $I_3$.

Actual practice has shown that the circuit in FIG. 2 furnishes a stable, temperature-compensated voltage $V_{Ref}$ in a supply voltage range of approx. 3 V up to the breakdown voltage dictated by the technology involved. The stability achieved is better than 0.5 percent. The output furnishing the reference voltage $V_{Ref}$ as shown in the circuit in FIG. 2 can be loaded, i.e. a circuit can be gate controlled with the reference voltage requiring a gate control current without influencing the stability of the circuit.

Figure 3:
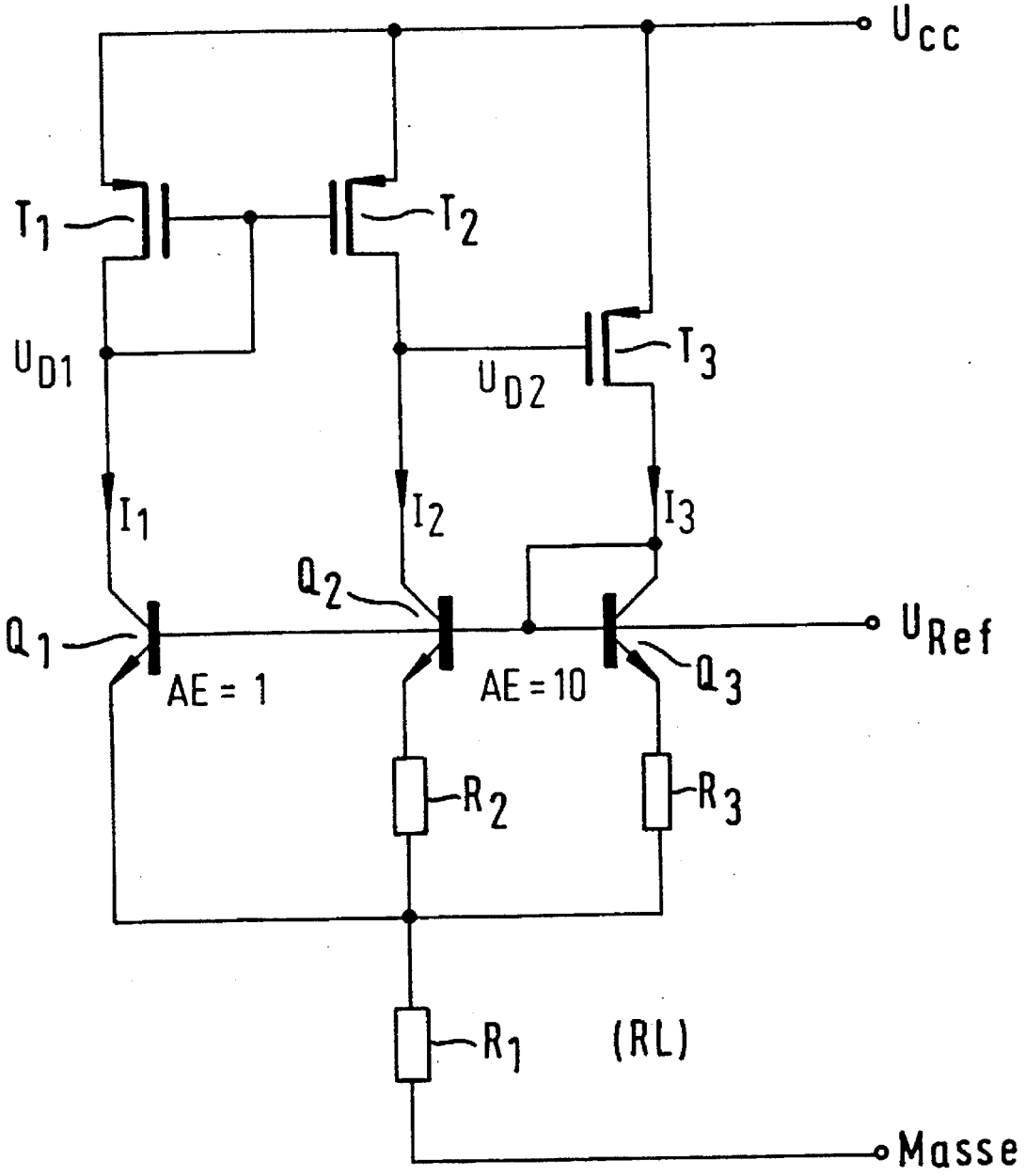
FIG. 3 is a circuit diagram of a further band gap reference voltage source according to the invention.

Another embodiment of a band gap reference voltage source is illustrated in FIG. 3. In this embodiment the current mirror required to achieve the equal currents $I_1$, $I_2$, $I_3$ is formed by incorporating the transistor $Q_3$ in the lead carrying the current $I_3$. This transistor operates as a diode by connecting its base to its collector and by providing it with an emitter resistance $R_3$ made equal to the resistance $R_2$. The emitter surface areas of the two transistors $Q_2$ and $Q_3$ are made the same, as indicated by AE=10 for the two transistors. In this circuit the branch circuits containing the transistors $T_3$ and $Q_3$ and the transistors $T_1$ and $Q_1$ again form a current mirror, thus resulting in the currents $I_1$ and $I_3$ being equal in value. Due to its current mirror effect the transistor $Q_3$ acting as the current source forces the voltages $V_{D1}$ and $V_{D2}$ to have the same value which in turn results in current $I_2$ having the same value as current $I_1$. In this way the stable reference voltage $V_{Ref}$ materializes at the output, i.e. at the interconnected base connections of the transistors $Q_1$ and $Q_2$ and $Q_3$, this reference voltage being highly stable irrespective of changes in the supply voltage $V_{cc}$ and the temperature as for the embodiment described before.

In the embodiment as shown in FIG. 3 compensation of the Early effect results from inserting resistor $R_3$ in the emitter lead of transistor $Q_3$ to act as the negative feedback resistor.

The embodiment illustrated in FIG. 3 is suitable for voltage control of subsequent stages since the output furnishing the reference voltage $V_{Ref}$ must not be loaded. On the other hand, this circuit embodiment has the advantage that it requires an operating current of less than 1 μA, i.e. enabling it to be employed also in circuits allowed to have only a very low value of current consumption.

I claim:

1. A circuit for providing a band gap reference voltage source, said circuit comprising:

first, second and third parallel circuit branches respectively providing first, second and third currents;

said first circuit branch including a first bipolar transistor having base, collector and emitter electrodes, and said second circuit branch including a second bipolar transistor having base, collector and emitter electrodes;

said first and second bipolar transistors being operable at respective current densities differing from each other;

a further bipolar transistor having base, collector and emitter electrodes, said further bipolar transistor being included in said third circuit branch;

said further bipolar transistor combining with said first bipolar transistor to define a first current mirror and combining with said second bipolar transistor to define a second current mirror for generating the currents required for achieving the differing current densities in the first and second bipolar transistors of the first and second circuit branches respectively; and a voltage follower stage connected to said first and second circuit branches for generating a reference voltage at the output thereof as a function of the collector voltage of one of said first and second bipolar transistors, the reference voltage also being applied to the base electrodes of said first and second bipolar transistors of the first and second circuit branches respectively.

2. A circuit as set forth in claim 1, wherein said first and second circuit branches respectively include first and second field-effect transistors serially connected to the respective one of said first and second bipolar transistors corresponding thereto;

each of said first and second field-effect transistors having input and output terminals and a control gate connected between the input and output terminals, the control gates of said first and second field-effect transistors being connected together;

a conductor connected between and to the control gates of said first and second field-effect transistors at one end thereof and to the output terminal of said first field-effect transistor at the other end thereof;

said voltage follower stage including a third field-effect transistor and a load resistor serially connected together, said third field-effect transistor having input and output terminals and a control gate connected between the input and output terminals;

the input terminals of said first, second and third field-effect transistors being connected to a voltage supply source;

said third circuit branch being interposed between said second circuit branch and said voltage follower stage in parallel relationship with respect thereto;

said third circuit branch including a fourth field-effect transistor having input and output terminals and a control gate connected between the input and output terminals;

the output terminal of said second field-effect transistor being connected to the control gate of said fourth field-effect transistor; and the output terminal of said fourth field-effect transistor being connected to the control gate of said third field-effect transistor.

3. A circuit as set forth in claim 1, wherein the output of said voltage follower stage at which the reference voltage is generated is the base electrode of said further bipolar transistor.

4. A circuit as set forth in claim 3, wherein said first and second circuit branches respectively include first and second field-effect transistors serially connected to the respective one of said first and second bipolar transistors corresponding thereto;

each of said first and second field-effect transistors having input and output terminals and a control gate connected between the input and output terminals;

the control gates of said first and second field-effect transistors being connected together;

a conductor connected between and to the control gates of said first and second field-effect transistors at one end thereof and to the output terminal of said first field-effect transistor at the other end thereof;

said third circuit branch further including a third field-effect transistor having input and output terminals and a control gate connected between the input and output terminals, said third field-effect transistor being serially connected to said further bipolar transistor;

the output terminal of said second field-effect transistor being connected to the control gate of said third field-effect transistor; and the base and collector electrodes of said further bipolar transistor being connected together such that said further bipolar transistor assumes a diode configuration.

5. A circuit as set forth in claim 1, wherein the surface areas of the emitter electrode for said first and second bipolar transistors respectively included in said first and second circuit branches are of a different size with respect to each other such that the differing current densities of said first and second bipolar transistors are achievable when the first and second currents are equal.

* * * * *